US011268293B2

(12) United States Patent
Neusch

(10) Patent No.: US 11,268,293 B2
(45) Date of Patent: Mar. 8, 2022

(54) BOLLARD FENCE

(71) Applicant: NEUSCH INNOVATIONS, LP, Marble Falls, TX (US)

(72) Inventor: William H Neusch, Marble Falls, TX (US)

( * ) Notice: Subject to any disclaimer, the term of this patent is extended or adjusted under 35 U.S.C. 154(b) by 784 days.

(21) Appl. No.: 15/992,083

(22) Filed: May 29, 2018

(65) Prior Publication Data

US 2018/0347227 A1 Dec. 6, 2018

Related U.S. Application Data

(60) Provisional application No. 62/512,678, filed on May 30, 2017.

(51) Int. Cl.

| | |
|---|---|
| ***E04H 17/14*** | (2006.01) |
| ***E04H 17/00*** | (2006.01) |
| ***E04H 17/22*** | (2006.01) |

(52) U.S. Cl.

CPC ..... *E04H 17/1439* (2013.01); *E04H 17/003* (2013.01); *E04H 17/1413* (2013.01); *E04H 17/22* (2013.01); *E04H 17/1478* (2021.01)

(58) Field of Classification Search

CPC ... E04H 17/003; E04H 17/1439; E04H 17/22; E04H 2017/1478; E04H 17/1413; E04H 17/1465; E04H 17/1417; E01F 15/003; E01F 9/685; E01F 15/141

See application file for complete search history.

(56) References Cited

U.S. PATENT DOCUMENTS

| | | | | |
|---|---|---|---|---|
| 3,141,655 | A * | 7/1964 | Platt | E01F 15/141 404/6 |
| 3,406,946 | A * | 10/1968 | Saultz | E04G 21/3223 256/19 |
| 5,152,507 | A * | 10/1992 | Lee | E01F 13/026 256/13.1 |
| 5,255,899 | A * | 10/1993 | von Grozny | E04H 17/1413 256/1 |
| 5,927,694 | A * | 7/1999 | Montepiano | E04H 12/2215 256/19 |
| 6,099,200 | A * | 8/2000 | Pepe | E01F 13/046 256/13.1 |
| 6,783,116 | B2 * | 8/2004 | Albritton | E01F 15/143 256/13.1 |
| 7,699,558 | B2 * | 4/2010 | Adler | E01F 9/685 404/6 |
| 7,717,641 | B2 | 5/2010 | Stice | |
| 7,722,285 | B2 | 5/2010 | Schram et al. | |
| 7,736,085 | B2 | 6/2010 | Neusch | |
| 7,850,391 | B2 | 12/2010 | Omar | |
| 8,684,571 | B1 | 4/2014 | Alaura et al. | |
| 9,500,001 | B2 * | 11/2016 | Sherstad | E04H 17/24 |
| 9,963,844 | B2 * | 5/2018 | Rohde | E01F 15/143 |
| 10,006,220 | B2 * | 6/2018 | Lee | E01F 9/692 |
| 10,422,156 | B1 * | 9/2019 | Morrow | E04H 17/1404 |

(Continued)

*Primary Examiner* — Matthew R McMahon

(74) *Attorney, Agent, or Firm* — Shackelford, Bowen, McKinley & Norton, LLP; Henry L. Ehrlich

(57) ABSTRACT

An exemplary bollard fence includes bollards having bottom ends secured in a concrete base, the bollards spaced apart and extending axially from the concrete base; an elongated member moveably disposed inside of each of the bollards, and a header member laterally interconnecting the upper ends of the bollards.

30 Claims, 8 Drawing Sheets

(56) References Cited

U.S. PATENT DOCUMENTS

| | | | | |
|---|---|---|---|---|
| 2004/0168389 | A1 | 9/2004 | Marsh et al. | |
| 2012/0319067 | A1* | 12/2012 | Millar | E04H 17/1439 256/19 |
| 2013/0284995 | A1* | 10/2013 | Myer | E04H 17/22 256/19 |
| 2015/0345173 | A1* | 12/2015 | Grasman | E04H 17/20 256/65.02 |

* cited by examiner

BOLLARD FENCE

BACKGROUND

This section provides background information to facilitate a better understanding of the various aspects of the disclosure. It should be understood that the statements in this section of this document are to be read in this light, and not as admissions of prior art.

Perimeter security fences are often used to separate a protected area from a threat side. Commonly these perimeter security fences are constructed of wire mesh topped with barbed wire and the like. Additional means, such as electric lines, video monitoring, motion sensors, guard dogs, and armed guard stations are commonly used with the structural fence to prevent and deter breaches. However, these common perimeter security fences and deterrents are not feasible for all circumstances, in particular, where long expanses of security fencing are required and that may be located long distances from security enforcement personnel.

SUMMARY

An exemplary bollard fence includes bollards having bottom ends secured in a concrete base, the bollards spaced apart and extending axially from the concrete base; an elongated member moveably disposed inside of each of the bollards, and a header member laterally interconnecting the upper ends of the bollards. The bollards may extend for example ten-feet and more above the concrete base. The header member can be fixedly connected to the bollards or the header member may permit axial movement of the bollards relative to the header and relative to one another. In accordance to some embodiments, the bollard fence may include one or more vertical sections of anti-climb and/or anti-scaling located at the upper ends of the bollards and above.

An exemplary bollard fence panel includes bollards spaced apart and extending axially parallel to one another from a concrete base, each of the bollards internally disposing an elongated metal member that is moveable relative to the bollard, and a header member laterally interconnecting the upper ends of the plurality of bollards. The bollard fence panel may be pre-formed for shipment to a location for installation. In a pre-formed bollard panel, the upper ends of the bollards may be laterally interconnected at the installation site.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
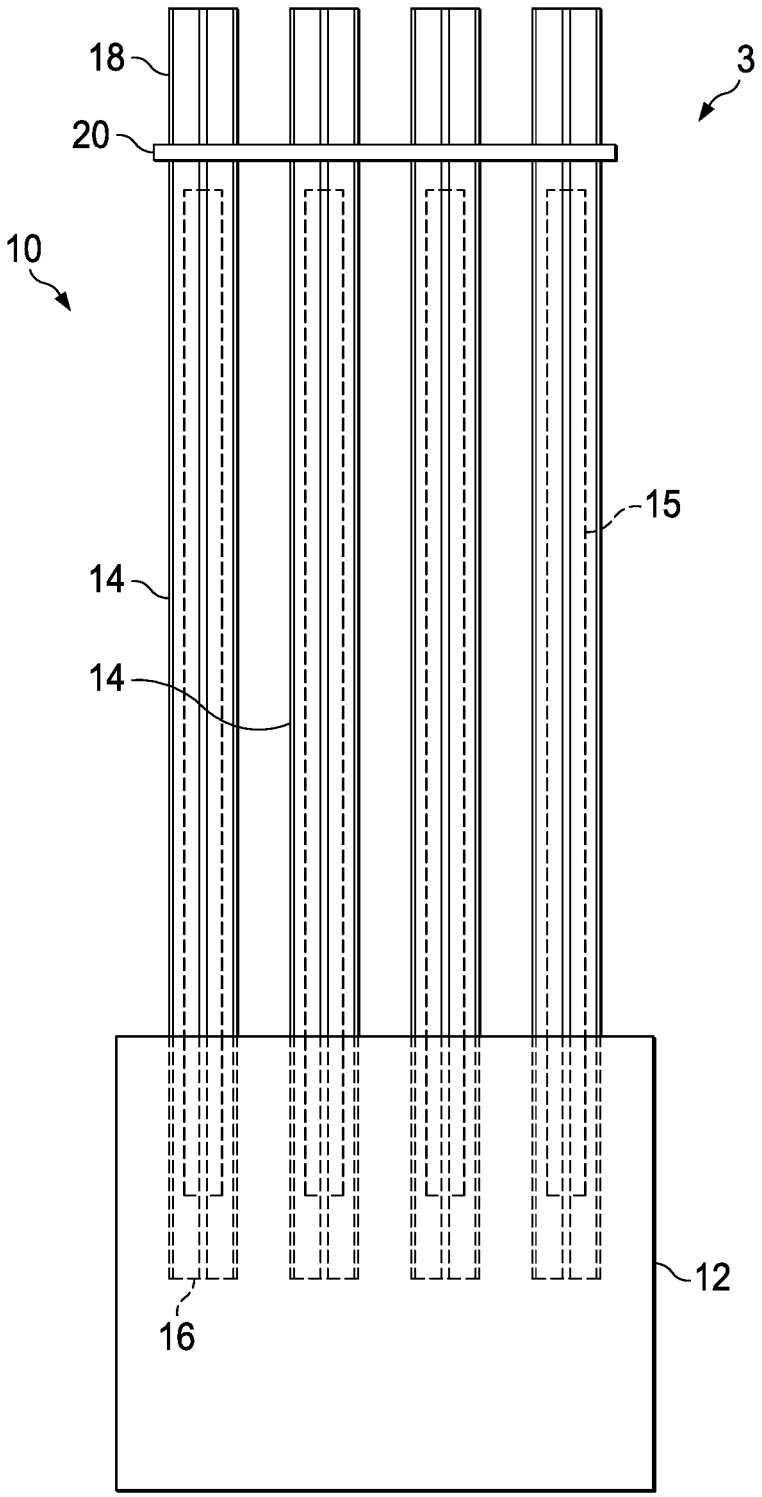
FIG. 1 is a schematic view of a bollard fence according to one or more aspects of the disclosure.

It is to be understood that the following disclosure provides many different embodiments, or examples, for implementing different features of various illustrative embodiments. Specific examples of components and arrangements are described below to simplify the disclosure. These are, of course, merely examples and they are not intended to be limiting. For example, a figure may illustrate an exemplary embodiment with multiple features or combinations of features that are not required in one or more other embodiments and thus a figure may disclose one or more embodiments that have fewer features or different combination of features than the illustrative embodiment. Therefore, combinations of features disclosed in the following detailed description may not be necessary to practice the teachings in the broadest sense, and are instead merely to describe particularly representative examples. In addition, the disclosure may repeat reference numerals and/or letters in the various examples. This repetition is for the purpose of simplicity and clarity and does not in itself dictate a relationship between the various embodiments and/or configurations discussed.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features. Further, the figures may illustrate exemplary embodiments that show features or combination of features that are not required in one or more embodiments and thus a specific figure may disclose one or more embodiments that have fewer features or different combination of features than those shown in the illustrated embodiment.

As used herein, the terms "connect," "connection," "connected," "in connection with," and "connecting" may be used to mean in direct connection with or in connection with via one or more elements. Similarly, the terms "couple," "coupling," and "coupled" may be used to mean directly couple or couple via one or more elements. Terms such as "up," "down," "top," and "bottom" and other like terms indicating relative positions to a given point or element may be utilized to more clearly describe some elements. Commonly, these terms relate to a reference point such as ground level.

Bollard fences are disclosed herein to provide a security perimeter to prevent or limit the ability of vehicles and pedestrians to enter a protected area. Embodiments of the bollard fence are suitable for use in locations that are not in physical view of security personnel and locations requiring lengthy response times to attempted breaches. The bollard fence may be deployed, for example, at airports, rail stations, seaports, manufacturing facilities, warehouses, refineries, power generation facilities, and national border crossings.

Refer now to the several figures illustrating non-limiting aspects of bollard fences. The bollard fence separates a protected side from a threat side and it is configured to prevent or limit the ability of a person to scale the fence unassisted and to cut or otherwise manually open holes through the bollard fence of greater than about twelve inches within a threshold time. In an exemplary embodiment, the bollard fence is configured to prevent a person from climbing to the top of the bollard fence from either the protected or the threat side unassisted, for example via the use of a ladder or another person. In an exemplary embodiment, the bollard fence includes anti-climb features that mitigate climbing aids such as grappling hooks and handholds. In an exemplary embodiment, the bollard fence prevents digging or tunneling below it for about six feet from the adjacent grade. In an exemplary embodiment the bollard fence prevents or deters for a threshold time the creation of a physical breach of the bollard fence of an opening larger than 12-inches in diameter or square using a sledgehammer, car jack, pick axe, chisel, battery operated impact tools, battery operated cutting tools, Oxy/acetylene torch or other similar hand-held tools. In accordance to an embodiment, the threshold time is thirty minutes. In an exemplary embodiment, the threshold time is one-hour. In an exemplary embodiment, the threshold time is at least one-hour and thirty-minutes for at least about twelve-feet of the bollard fence extending vertically from the grade. In an exemplary embodiment, the threshold time is four-hours. In an exemplary embodiment, the bollard fence is aesthetically pleasing.

Figure 5:
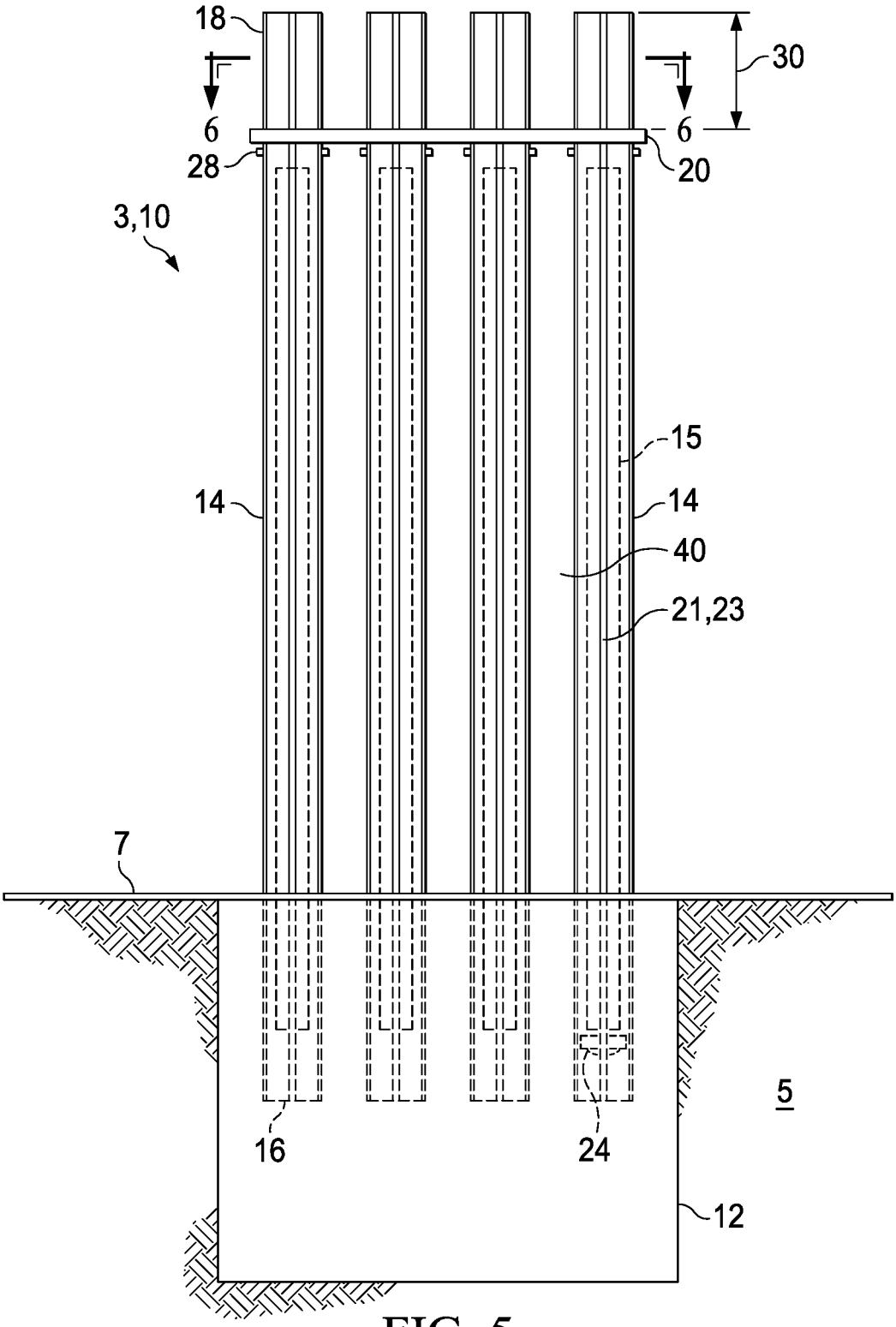
FIG. 5 is a schematic view of a bollard fence according to one or more aspects of the disclosure.
Figure 6:
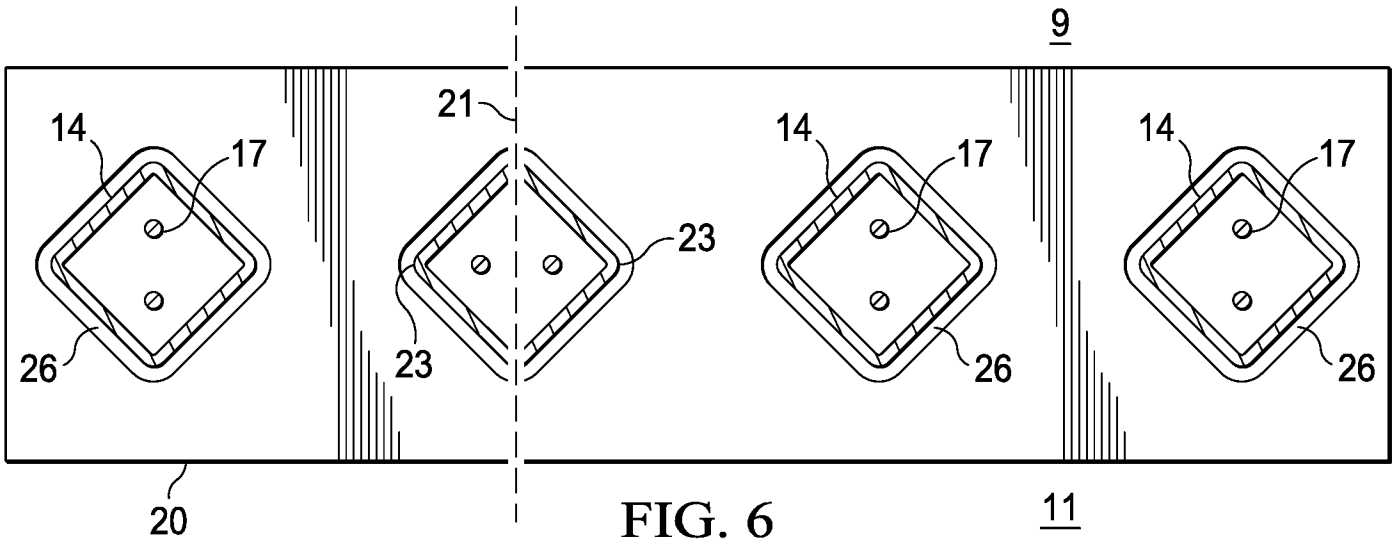
FIG. 6 is a sectional view along the line 6-6 of FIG. 5.
Figure 12:
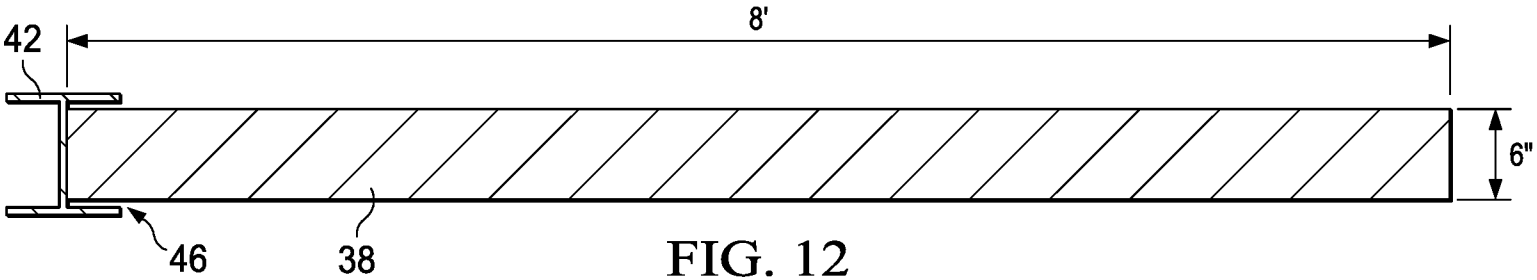
FIG. 12 is a sectional view along the line 12-12 of FIG. 10.
Figure 7:
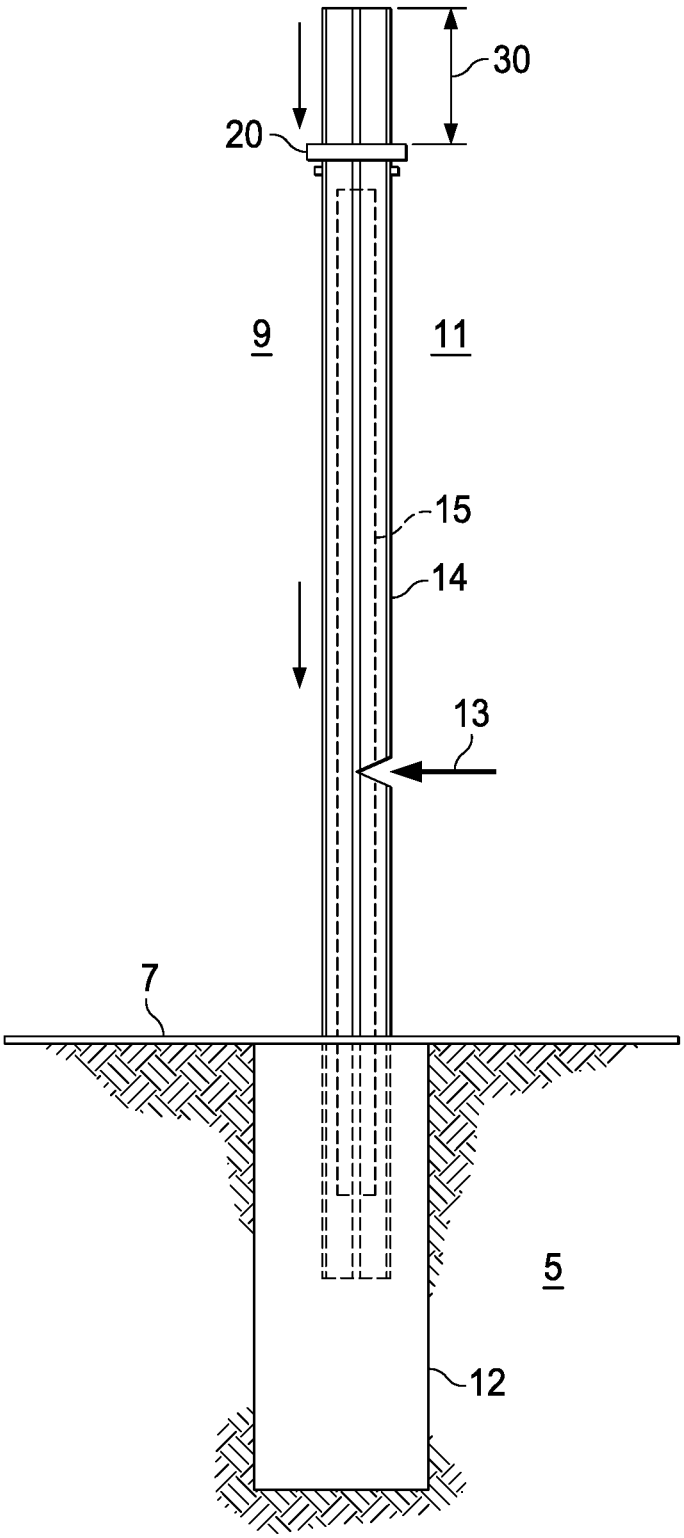
FIG. 7 is a schematic side view of the bollard fence of FIG. 5 according to one or more aspects of the disclosure.

FIG. 1 illustrates a section of an exemplary bollard fence generally denoted by the numeral 10. The illustrated section or panel 3 may be pre-formed, on- or off-site, prior to installation in the ground 5. Bollard fence 10 includes a base 12, e.g. a concrete base, and a plurality of laterally spaced apart bollards 14 having bottom ends 16 secured in the base 12. One or more elongated members 15 (e.g., pipe, rods, rebar) are positioned inside of each of the bollards. The elongated members 15 are moveable, rotationally, radially, and/or axially, relative to the bollard. Adjacent bollards 14 are laterally interconnected at their upper ends 18 to provide structural support to a severed bollard against bending and tipping. According to an embodiment, at least two adjacent bollards are laterally interconnected. In an exemplary embodiment, three or more adjacent bollards are laterally interconnected. A member 20, generally referred to as a header, laterally interconnects the upper ends 18 of the adjacent bollards 14. In the exemplary embodiment of FIG. 1, the header 20 fixedly connects the adjacent bollards 14 laterally and axially relative to one another. For example, a fixed header 20 may be a metal piece, such as angle iron, welded to the respective adjacent bollards 14. In accordance to some embodiments, the fixed header may be incorporated in a housing that can function as an anti-climb feature. In some embodiments, such as illustrated in FIGS. 5-7, the header 20 is a floating header that is slidably connected with the adjacent bollards to laterally interconnect the adjacent bollards and allow the adjacent bollards to float relative to one another. "Float" is used herein to mean that the floating member, or a portion of the floating member, is free to move axially, at least in the direction of gravity.

Figure 2:
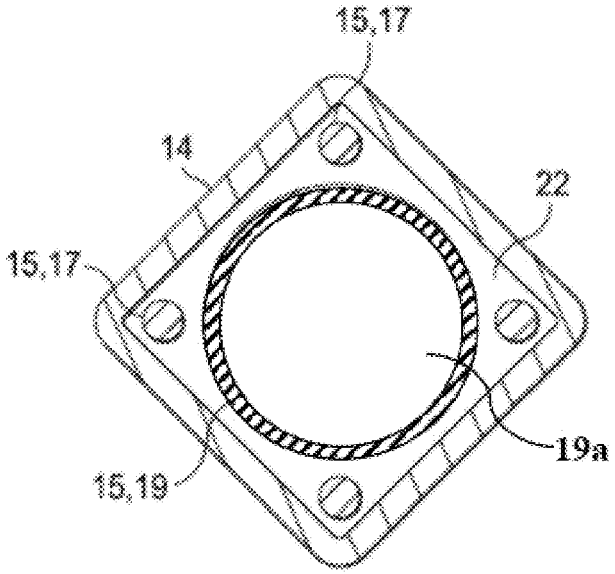
FIGS. 2-4 are schematic views of bollards internally disposing different exemplary configurations of elongated members according to one or more aspects of the disclosure.
Figure 3:
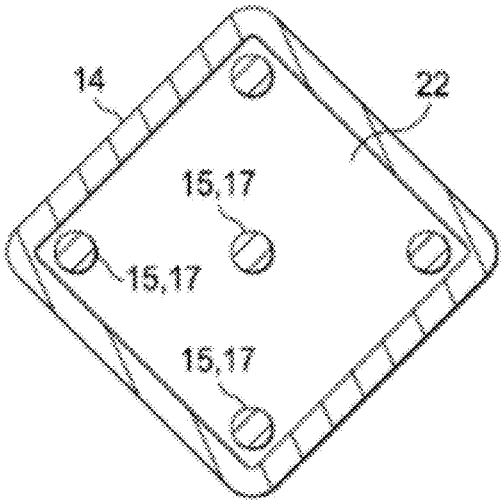
Figure 4:
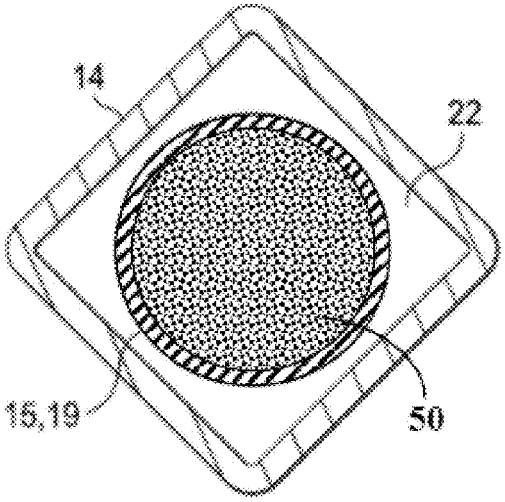

FIGS. 2 to 4 illustrate section views of exemplary bollards 14. Exemplary bollards 14 are formed of a steel pipe or tubing. In the illustrated examples, the bollards 14 have a square cross-section; however, it may have a different shape such as a circular cross-section. In an exemplary embodiment, the bollard is a metal member, such as and without limitation, a six by six-inch tube steel (TS) or hollow structural section (HSS) with a 0.375 inch wall thickness. In another exemplary embodiment, the bollard 14 is a metal member, such as and with limitation, an eight by eight inch tube steel or hollow structural section with a 0.375-inch wall thickness.

One or more elongated members 15 are disposed inside of the bollard 14 and the elongated member is moveable relative to the bollard 14. The elongated members 15 may include, for example and without limitation, one or more of elongated rods, reinforcement bars ("rebar"), and tubing (e.g., round or square). In the exemplary embodiments, the elongated members 15 are constructed of metal (e.g., steel), however, they may be constructed of a fiber or composite material that may be resistant to cutting by a blade and/or torch. Moveable relative to the bollard 14 means that the elongated members 15 can rotate, bend, flex, and/or move axially (e.g., float) relative to the bollard. For example, the one or more elongated members 15 are not fixedly attached, at least not along the entire length, to the bollard 14 permitting the elongated member 15 move relative to the bollard 14. In an exemplary embodiment, the elongated member 15 is disposed in the bollard in a manner to move axially relative to the bollard in certain circumstances.

FIG. 2 illustrates an exemplary embodiment of a bollard 14 internally disposing a combination of different types of elongated members 15. Bollard 14 internally disposes one or more elongated solid members 17 (e.g., rebar) and an elongated tubular member 19. FIG. 3 illustrates an exemplary embodiment of a bollard 14 internally disposing multiple elongated solid members 17, for example and without limitation #6 rebar or #8 rebar. Although FIG. 3 illustrates multiple elongated solid members, the bollard 14 may dispose only a single elongated solid member. In accordance to an exemplary embodiment, the elongated solid member 17 is a length of rebar, e.g., #6 or #8 rebar, disposed in the bollard 14 and extending substantially the length of the bollard 14 without having an end secured in the concrete of the base 12. FIG. 4 illustrates an exemplary embodiment of a bollard 14 internally disposing an elongated tubular member 19.

In an exemplary embodiment, the internal cavity 22 of the bollard 14 is not filled with a filler material, such as concrete, so that the one or more elongated members 15 can move relative to bollard 14. It is the inventor's experience that a filling a bollard with concrete may aid in cutting the bollard. The elongated solid member 17 may rotate, bend, and/or axially move relative to the bollard 14 increasing the difficulty in cutting the elongated solid member 17. For example, it is difficult for blade to bite into the elongated solid member 17 due to the elongated solid member being pushed away from the blade and/or the elongated solid member rotating. The weight of the unsupported upper section of an elongated solid member 17 may cause the blade to bind. If an elongated solid member 17 is severed, the upper section may fall spanning the opening that was cut in the bollard and presenting an additional element that must be removed to breach the bollard fence. While multiple elongated solid members 17 increase the number of members that have to be cut to breach the bollard fence, a single elongated solid member 17, such as in the embodiment of FIG. 3, may provide a sufficient deterrent to severing a bollard 14 in less time than a threshold requirement. A single elongated solid member 17 may move more freely inside of the bollard increasing the difficulty in capturing and holding the single elongated solid member 17. The lower end of the elongated solid member 17 may be secured in the lower end of the bollards by the base 12, however, in some embodiments, the one or more elongated solid members are not secured to the base or otherwise attached to the bollard.

The elongated tubular member 19 can be configured to rotate or spin relative to the bollard 14, for example in accordance to U.S. Pat. No. 7,736,085, which is incorporated in its entirety herein. The rotatable elongated tubular member 19 may be circular or square. In the illustrated example, the elongated tubular member 19 is round to aid in spinning relative to the square bollard 14 without having edges to bite on the square bollard 14. The elongated tubular member 19 may or may not be axially suspended in the bollard 14 from its upper end as disclosed in U.S. Pat. No. 7,736,085. The lower end of the elongated tubular member 19 may sit atop the concrete base that is inside of the bottom end of the bollards. A swivel or rotating mechanism 24 can be added to promote rotation of the elongated tubular member 19. For example, and without limitation, a rotating base 24 (turntable), illustrated in the right bollard of FIG. 5, may be located below the elongated tubular member 19 inside of the bollard 14. The bore 19*a* of the elongated tubular member 19 may be empty (FIG. 2) or contain filler material 50 (FIG. 4), such as concrete or another material of a type that deters cutting by a blade or torch.

FIGS. 5 through 7 illustrate an exemplary panel 3 of a bollard fence 10 incorporating a floating header 20. Panel 3 is installed with the base 12 positioned in the ground 5 below the adjacent grade 7 to separate a protected side 9 from a threat side 11. In this embodiment, a floating header 20 is slidably connected to the upper ends 18 of the adjacent bollards 14. The floating header 20 laterally interconnects the bollards to provide structural support to the individual bollards against a bending or tipping force, and it allows the individual bollards to "float" axially relative to the other bollards in the bollard fence panel 3.

In the various embodiments, one or more of the elongated members 15 may float relative to the bollard and/or the bollards may float relative to one another. "Float" is utilized herein to mean that at least a portion of the floating member is free to move axially in the direction of gravity if the floating member is severed. For example, with reference to FIG. 7, a horizontal cut 13 is made in a bollard 14. If the bollard 14 and the internal elongated members 15 are severed, the lateral interconnection of the adjacent bollards 14 via the header 20, fixed or floating, prevents or mitigates the bollard 14 being bent or tipped out of the vertical orientation to create an opening in the bollard fence 10 above the cut 13. If the header 20 is a floating header, the upper section of the severed bollard will move downward closing the cut, binding the cutting blade, and blocking access to the internally disposed elongated members 15. Cutting around the circumference of the bollard is hampered by the dimensions of the bollards and the small opening 40 (gap), for example about four inches, between the adjacent bollards 14. For a cutting blade, or torch, to reach the internally disposed elongated member 15, the bollard 14 will have to be axially supported. Cutting or otherwise removing the one or more internally disposed elongated members 15 is hampered at least as described with reference to FIGS. 2-4.

FIG. 6 is a sectional view of the bollard fence panel 3 along the line 6-6 of FIG. 5. Each of the bollards 14 in FIG. 6 is shown internally disposing two elongated solid members 17. The bollards 14 may internally dispose only one elongated solid member 17 or more than two elongated solid members 17. All of the bollards in a panel or other section of a bollard fence may utilize the same configuration of internally disposed elongated members 15 or the bollards may utilize different configurations of the internal elongated members 15.

The exemplary floating header 20 illustrated in FIGS. 5-7 is constructed of a metal plate that extends perpendicular to the longitudinal or vertical axis of the bollards 14. The floating header 20 includes laterally spaced apart passages 26 to slidingly dispose the spaced apart bollards 14. The floating header 20 permits the bollards and the header to move axially relative to one another. The floating header 20 is supported at a vertical height relative to the base 12 and the grade 7 by stops 28. The stops 28 in FIGS. 5 and 7 are fixedly connected to the bollard 14 to provide a standoff distance 30 of the floating header 20 relative to the upper end 18 of the bollards 14 in the normal installed position. The standoff distance 30 may correspond at least to a distance that a bollard 14 can move axially downward toward the grade, for example if an intermediate section of the bollard is removed, and still be laterally supported at the upper ends 18 by the adjacent bollards 14. In an exemplary embodiment, the bollards 14 extend approximately six-feet above the floating header 20 to allow a severed bollard to fall approximately five feet and still be laterally supported by the floating header 20 and the adjacent bollards. The floating header 20 may be arranged in different configurations and may be incorporated into another structure such as a metal box.

The stops can be provided by various constructions including without limitation, collars, tabs, and tabs formed or connected (e.g., welding) to the outer surface of the bollard, and pins extending laterally through the bollard. The top ends of each of the bollards may serve as the stops, with the header suspended from the top ends of the bollards.

In accordance to an exemplary embodiment, the bollards 14 are constructed out of square pipe and the bollards 14 in a bollard fence panel 3 are oriented in the same direction. For example, with reference in particular to FIGS. 5 and 6, a diagonal plane 21 extends through opposite corners 23 of each bollard 14 and extends generally perpendicular to the lateral run of the bollard fence panel 3 and of the bollard fence 10.

Figure 8:
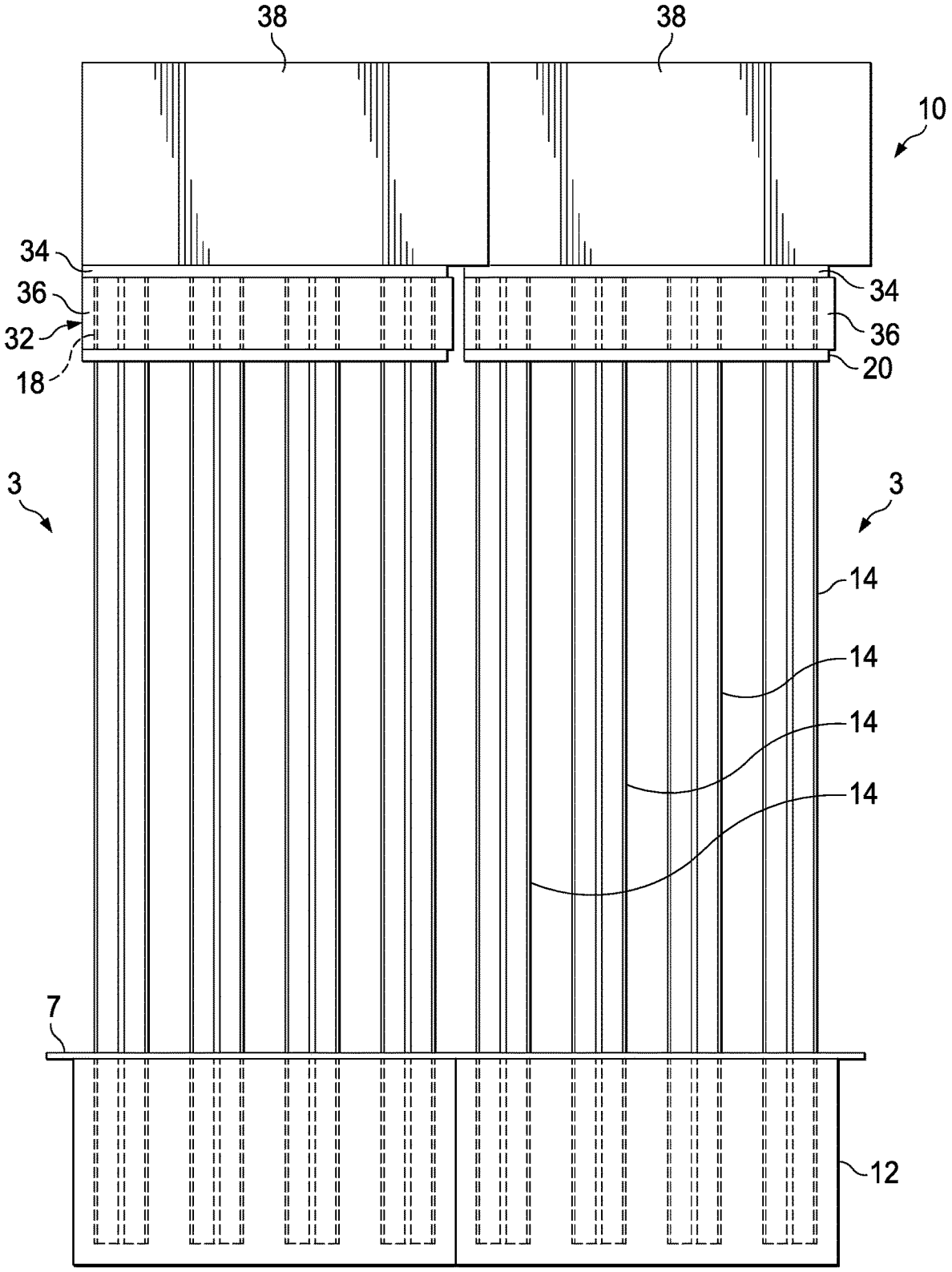
FIG. 8 is a schematic view of a bollard fence according to one or more aspects of the disclosure.

FIG. 8 illustrates exemplary bollard fence 10 in accordance to aspects of the disclosure. Two bollard fence panels 3 are installed side-by-side to form a horizontal length of bollard fence 10. The bollards 14 internally dispose one or more elongated members 15 as described for example with reference to FIGS. 2-4. In this example, the header 20 is incorporated into a header assembly 32, which may be a floating or a fixed header. The header assembly 32 includes the header 20 connected to a top member 34, e.g., a steel plate, by vertical members 36. One or more of the vertical members may be steel plates. The top member 34 may rest on the upper ends 18 of the bollards 14 in the bollard fence panel 3. Accordingly, in a floating header 20 configuration the upper ends 18 of the bollards act as the stops described with reference to FIG. 5. The header 20, floating or fixed, can have the structural strength to maintain the desired vertical position as long as one or more of the bollards in the panel has not been compromised. The header assembly 32 may be constructed as box with the vertical members 36 constructed of steel panels for aesthetics, to provide the desired structural strength to the header 20, to conceal and/or protect features of the bollard fence, and/or to serve as an anti-climb feature.

An additional top panel 38 may be located at the upper most end of the bollard fence 10, for example positioned on a header assembly 32, to provide an anti-climb feature. The top panel 38 may be formed of one or more elements, such as and without limitation, metal mesh fencing, barbed or razor wire, and concrete slabs. The vertical span and the construction of the top panel 38 can function as an anti-climb feature. The top panel 38 may have a mass, such as a concrete slab, to provide an anti-tampering deterrent to lifting a bollard 14 from a floating header to overcome the vertical collapsing and binding characteristics of the floating bollards.

FIGS. 9 through 12 illustrate an exemplary embodiment of a panel 3 of a bollard fence 10. The bollard fence panel 3 includes at least two laterally spaced apart bollards 14 having bottom ends disposed in a concrete base 12. In the illustrated examples, the bollard fence panel 3 includes three or more laterally interconnected bollards 14. All or some of the features illustrated in FIGS. 9-12 may be utilized to construct a bollard fence 10 in accordance to this disclosure.

Figure 9:
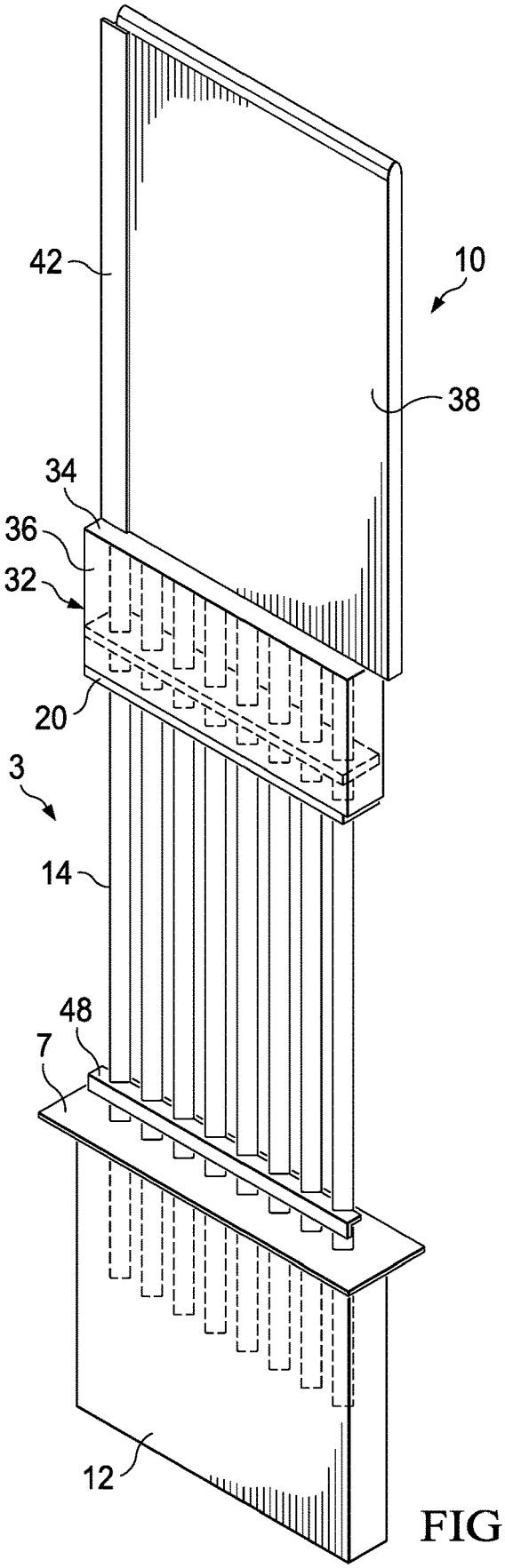
FIG. 9 is a perspective view of a bollard fence according to one or more aspects of the disclosure.
Figure 10:
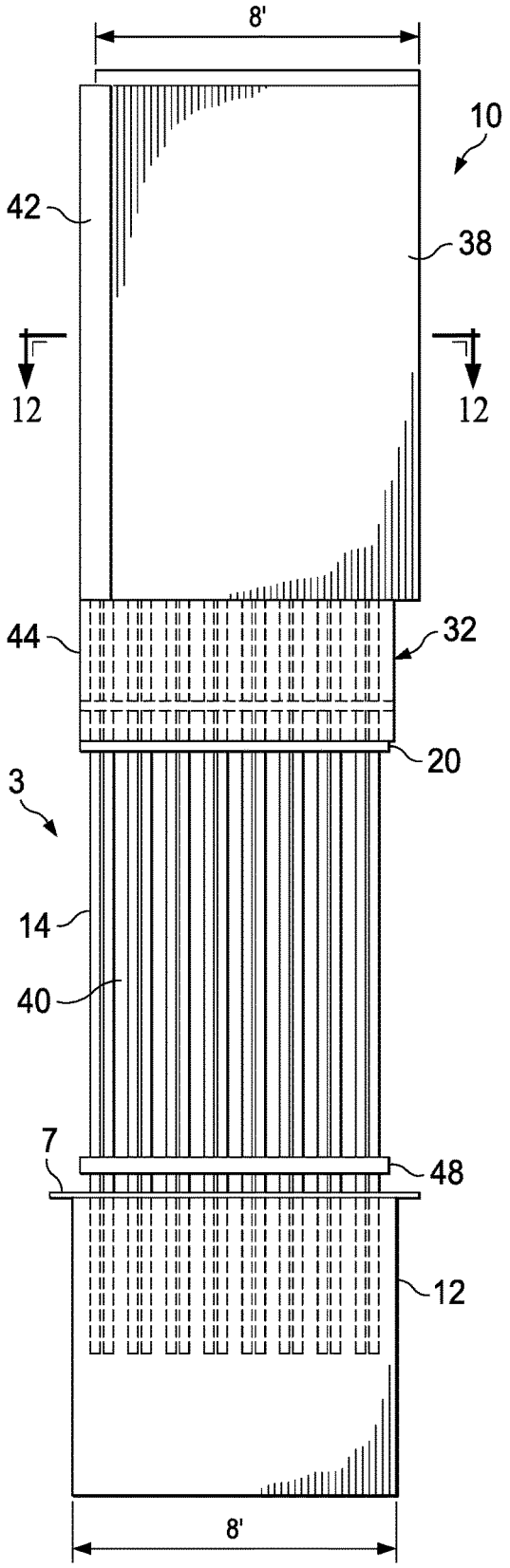
FIG. 10 is an elevation view of a bollard fence according to one or more aspects of the disclosure.
Figure 11:
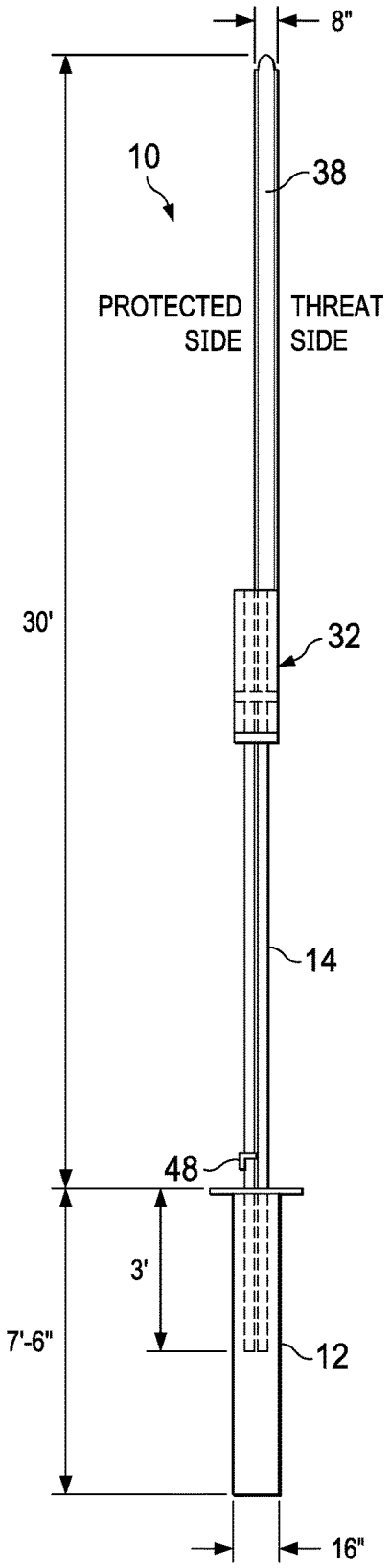
FIG. 11 is a side, elevation view of a bollard fence according to one or more aspects of the disclosure.

The header assembly 32 includes the header 20 laterally interconnecting the adjacent bollards 14 in the bollard fence panel 3 to provide structural support to individual bollards against tipping. In the example of FIGS. 9-11, the header assembly 32 includes the header 20 and a top member 34 interconnected by vertical members 36. The header 20 may be a fixed header that fixedly connects the adjacent bollards laterally and axially or the header 20 may be a floating header that laterally connects the adjacent bollards and allows axial movement the bollards relative to one another. A top panel 38 is positioned on the top member 34 of the header assembly 32.

The illustrated bollard fence 10 is configured to extend for example thirty-feet above grade 7 and the concrete base extends about eight feet below grade 7. In an exemplary embodiment, all or a portion of the bollard fence panel 3 is pre-formed for installation in the ground and for connection to laterally adjacent fence sections to create an elongated continuous bollard fence 10. For example, a pre-formed bollard panel 3 may include a two or more bollards 14, a concrete base 12, and a header 20 or header assembly 32.

In accordance to an exemplary embodiment, the base 12 is formed of concrete and extends about eight feet from top to bottom such that when installed the concrete base extends about eight-feet below grade 7 to prevent a person from digging or tunneling below the bollard fence 10 for at least six-feet below grade 7.

The bollards 14 extend axially parallel to one another with an open gap 40 for example about 4 inches, between the adjacent bollards. The gaps 40 allow water to flow through the lower portion of the bollard fence 10. The gaps 40 may also provide an anesthetically pleasing quality be blending the bollard fence 10 into the surrounding environment.

In the exemplary embodiment illustrated in FIGS. 9-11, the bollards extend at least twelve-feet above grade 7. In an exemplary embodiment, the lower twelve-feet of the bollard fence 10 is configured to prevent the creation of a physical breach larger than twelve-inches in diameter or square in less than one-hour, thirty-minutes, using a sledgehammer, car jack, pick axe, chisel, battery operated impact tools, battery operated cutting tools, Oxy/acetylene torch or other similar hand-held tools.

In FIGS. 9-11, the bollards 14 extend about three-feet into the concrete base 12 and extend at least twelve-feet above the adjacent grade 7. An anti-climb feature in the form of a header assembly 32 is attached to the upper ends of the bollards 14, for example beginning at about twelve-feet from grade. In this example, the header assembly 32 includes the header 20 that laterally interconnects the adjacent bollards 14 of the bollard fence panel 3. The anti-climb header assembly 32 includes steel panels as vertical members 36. The header assembly 32 extends vertically about four-feet to six-feet or more to the top member 34. The header 20 may be a fixed header or a floating header.

A top panel 38 is mounted on the top member 34 extending the total vertical height, relative to the adjacent grade, to thirty-feet. In this example, the top panel 38 is a concrete panel. The top panel can be mounted atop the header assembly 32 prior to installation of the bollard fence panel 3 in the ground or post-installation. In accordance to one or more embodiments, the top panel 38 is placed in position after the lower section is installed. For example, with reference in particular to FIGS. 11 and 12, a vertical connector 42 extends axially from one lateral end 44 of the header assembly 32 and forms female recess 46 for inserting the concrete top panel 38. For example, the illustrated connector 42 is a beam (e.g., W-beam) with the female recess 46 provided on the opposite sides of the web. After two bollard fence panels 3 are installed in the ground adjacent to one another a concrete top panel 38 can be lowered into place with its lateral edges located in the female recesses 46 of the adjacent connectors 42.

In an example of constructing a bollard panel 3, a number of bollards 14 are arranged spaced lateral apart forming a gap 40 between adjacent bollards 14 and extending axially parallel to one another. A member 48 (FIGS. 9-11), such as a piece of angle iron, can be attached, for example by welding, to the bollards 14 to hold them in position. The bottom ends 16 of the bollards 14 are then secured in a concrete base 12. The member 48 can be removed prior to installing the panel 3 in the ground. The member 48 should be positioned close to grade level 7, in particular if it is not removed, so that it cannot be used as a step for scaling the fence. Additional elements of the bollard fence panel 3, such as the one or more elongated members 15 and the header 20 and/or header assembly 32, can be assembled with the bollards 14 prior to and/or after erecting in the ground 5.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features. Further, the figures may illustrate exemplary embodiments that show features or combination of features that are not required in one or more embodiments and thus a specific figure may disclose one or more embodiments that have fewer features or different combination of features than those shown in the illustrated embodiment.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A bollard fence, comprising:

a concrete base;

bollards having bottom ends secured in the concrete base, the bollards spaced apart and extending axially from the concrete base;

an elongated member moveably disposed inside of each of the bollards, wherein the elongated member is free to move axially, laterally, and rotationally inside the bollard; and a header member laterally interconnecting upper ends of the bollards.

2. The bollard fence of claim 1, wherein the elongated member is a solid metal member.

3. The bollard fence of claim 1, wherein at least one of the bollards internally disposes a single elongated member consisting of a solid metal member.

4. The bollard fence of claim 1, wherein the elongated member is a tubular member.

5. The bollard fence of claim 1, wherein the elongated member in at least one of the bollards comprises an elongated solid metal member and an elongated tubular member.

6. The bollard fence of claim 1, wherein the header member is not attached to the bollards in an axially fixed position.

7. The bollard fence of claim 1, wherein the header member fixedly interconnects the bollards to one another laterally and axially.

8. The bollard fence of claim 1, further comprising an axially extending panel mounted at upper ends of the bollards.

9. The bollard fence of claim 8, wherein the header member fixedly interconnects the bollards to one another laterally and axially.

10. The bollard fence of claim 8, wherein the header member is not attached to the bollards in an axially fixed position.

11. The bollard fence of claim 1, further comprising an axially extending steel panel mounted at upper ends of the bollards; and a top structure extending vertical above the steel panel.

12. The bollard fence of claim 11, wherein the top structure is a concrete panel.

13. The bollard fence of claim 11, wherein the header member fixedly interconnects the bollards to one another laterally and axially.

14. The bollard fence of claim 11, wherein the header member fixedly interconnects the bollards laterally and allows axial movement of the bollards relative to the header member.

15. The bollard fence of claim 14, wherein the steel panel comprises the header member.

16. A bollard fence panel, comprising:

bollards spaced apart and extending axially parallel to one another, wherein each of the bollards is a hollow steel section having a length of about ten feet or greater;

a rigid member attached to the bollards proximate to lower ends of the bollards and securing the bollards in a spaced apart and planar arrangement with a gap of about four inches between adjacent bollards;

each of the bollards internally disposing an elongated metal member, the elongated member moveable relative to the bollard, wherein the elongated member is free to move axially, laterally, and rotationally inside the bollard; and a header member laterally interconnecting upper ends of the bollards.

17. The bollard fence panel of claim 16, wherein the header member fixedly interconnects the bollards laterally and axially.

18. The bollard fence panel of claim 16, wherein the header member fixedly interconnects the bollards laterally and allows axial movement of the bollards relative to the header member.

19. The bollard fence panel of claim 16, wherein each bollard comprises one or more of a solid metal member and/or a tubular member.

20. The bollard fence panel of claim 16, wherein the elongated member is rebar.

21. A bollard fence, comprising:

a concrete base positioned below a ground level;

bollards extending vertically about ten feet or more above ground level and laterally separated by, an open gap of about four inches, wherein the bollards are hollow steel sections having bores;

a header member laterally interconnecting upper ends of the bollards; bottom ends of the bollards positioned inside the concrete base; and an elongated member contained within the bore of each of the bollards, wherein the elongated member is free to move axially, laterally, and rotationally inside the bollard.

22. The bollard fence of claim 21, wherein the bore of each of the bollards is not filled with a filler material.

23. The bollard fence of claim 21, wherein the elongated member is a pipe.

24. The bollard fence of claim 21, wherein the elongated member is rebar.

25. The bollard fence of claim 21, wherein the elongated member is a pipe; and each of the bores further comprising a metal rod positioned outside of the pipe.

26. The bollard fence of claim 21, wherein the header member comprises a generally horizontal plate; and each bollard extending through a passage in the plate, wherein the bollards are not secured to the plate in a fixed position.

27. The bollard fence of claim 26, wherein the plate is positioned about ten feet or greater above the ground level; and the upper ends extend a standoff distance above the plate.

28. The bollard fence of claim 26, wherein the elongated member is a pipe.

29. The bollard fence of claim 26, wherein the elongated member is rebar.

30. The bollard fence of claim 26, wherein the elongated member is a pipe; and each of the bores further comprising a metal rod positioned outside of the pipe.

* * * * *